United States Patent [19]

Leliaert

[11] 4,067,147

[45] Jan. 10, 1978

[54] METHOD AND APPARATUS FOR BOWL TYPE VIBRATORY FINISHING

[75] Inventor: Raymond M. Leliaert, South Bend, Ind.

[73] Assignee: Wheelabrator-Frye, Inc., Hampton, N.H.

[21] Appl. No.: 720,267

[22] Filed: Sept. 3, 1976

[51] Int. Cl.[2] ..... B24B 31/06; B24B 1/00

[52] U.S. Cl. ..... 51/163.2; 51/313

[58] Field of Search ..... 51/7, 163.1, 163.2, 51/313, 316; 241/171; 259/29.35

[56] References Cited

U.S. PATENT DOCUMENTS

| | | | |
|---|---|---|---|
| 3,618,267 | 11/1971 | Huber | 51/163.2 |
| 3,724,146 | 4/1973 | Fahey | 51/163.2 |
| 3,906,679 | 9/1975 | Riedel | 51/163.2 |
| 3,990,188 | 11/1976 | Balz | 51/163.2 X |
| 4,001,979 | 1/1977 | Elkins | 51/163.2 |

FOREIGN PATENT DOCUMENTS

| | | | |
|---|---|---|---|
| 1,375,765 | 11/1974 | United Kingdom | 51/163.2 |

*Primary Examiner*—Harold D. Whitehead
*Assistant Examiner*—Nicholas P. Godici
*Attorney, Agent, or Firm*—McDougall, Hersh & Scott

[57] ABSTRACT

A vibratory finishing mill of the bowl type in which a short annulus of the bowl is depressed to define a well, and in which the parts are separated from the media, when the finishing operation has been completed, by placing a screen member over the leading portion of the well, as a continuation of the bottom wall of the bowl, to retain the parts on the surface while the media falls into the well for return to the bowl.

12 Claims, 3 Drawing Figures

FIG. 1
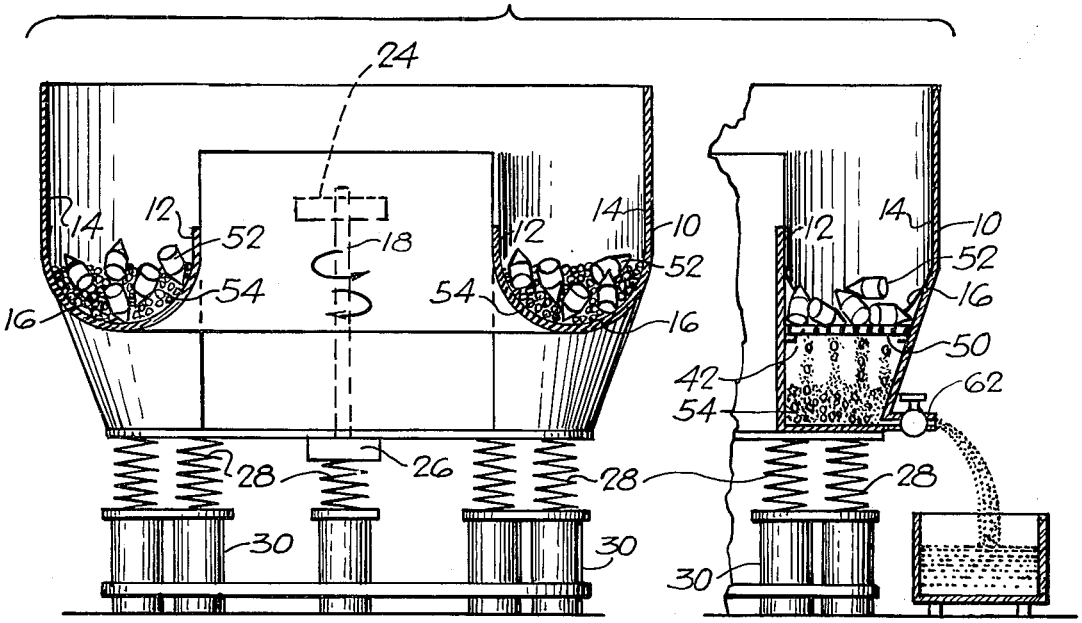
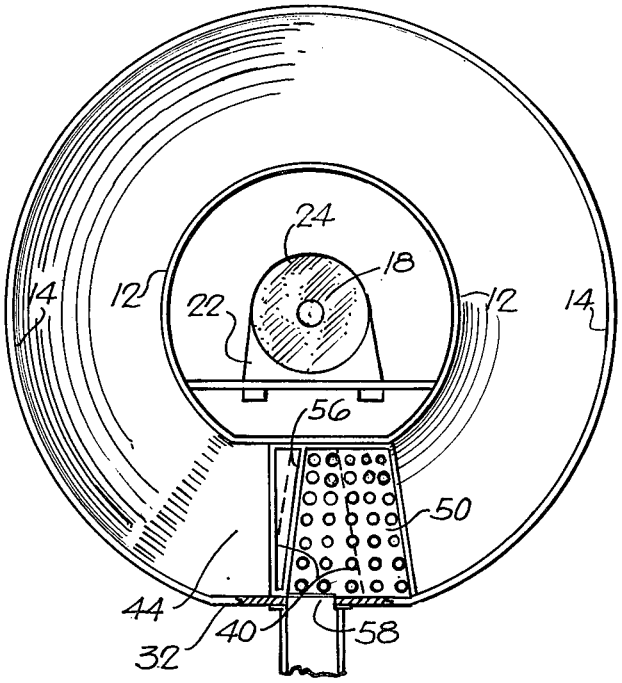
FIG. 2

METHOD AND APPARATUS FOR BOWL TYPE VIBRATORY FINISHING

This invention relates to a vibratory finishing device in which parts to be finished and media are subjected, in admixture, to vibratory action for the purpose of polishing, deburring, or otherwise finishing said parts.

Parts to be finished comprise a wide variety of articles including metal castings, molded plastic parts, and the like articles of manufacture, and the media may comprise an abrasive or polishing material such as granite, aluminum oxide, sand, chipped marble, steel bars, and molded plastic pellets of smaller dimension than the parts and which also may beneficially contain a fluid or finely divided polishing material in admixture with the media to form a part thereof.

When the parts and media are vibrated in admixture in said vibratory device, the resulting action causes the surfaces of the parts to be rubbed in a polishing, abrasive, or abrading action.

For the most part, such vibratory devices comprise annular containers having a curvilinear bottom wall with axially spaced inner and outer side walls extending upwardly continuously from the ends of the bottom wall, with springs or other resilient means supporting the container to enable vibratory movements in response to rotation of one or more eccentrics distributed along the axis of the container. An elliptical movement is imparted to the parts and media for travel continuously down one side wall across the bottom and up the other side wall and back across the top as the parts and media are advanced circumferentially about the container. By reason of the circular configuration of the container, the parts and media can be allowed to recirculate in the manner of a continuous operation, in response to such vibratory movement, until the desired surface treatment or finishing operation has been completed.

Upon completion of the finishing or abrading operation, it is necessary to separate the parts from the media for removal of the parts while the media is returned to the container for further use. Various procedures have been adopted for such separation of parts from the media. In the McKibben U.S. Pat. Nos. 3,553,900 and 3,407,542, use is made of a separation screen which overlies a portion of the bowl. When it is desired to unload the parts, an arcuate ramp is lowered into the bowl into the path of the parts and media. In response to continued vibratory action, the parts and media travel up the ramp onto the screening member. The media sifts through the screen for return gravitationally into the underlying portion of the bowl while the parts remain on the surface of the screening member from which they are carried off.

In the Ferrara U.S. Pat. No. 3,693,298, use is also made of a ramp over which the parts and media travel during vibratory movement about the bowl. When the finishing operation is completed, a screening member is inserted in endwise alignment with the ramp. The screening member retains the parts which are advanced to a delivery slot at the inner wall, while the media sifts through the screening member for return to the bowl.

In a series of Balz U.S. Pat. Nos. 3,400,495 and 3,466,815, a vertical septum or dam is located in the bowl forcing the parts and media to climb over the dam during vibratory movement in the finishing operation. Again, when the finishing operation has been completed, a screening member is introduced at an upper level to receive the parts and media overflowing the dam to separate the parts on the surface from the media which sifts through for return gravitationally to the underlying portion of the bowl.

In all of these devices, the parts and media are raised from a normal level in the bowl to an upper level where they are displaced onto a screen which retains the parts and allows the media to sift therethrough into the underlying portion of the bowl for continued circulation. Considerable energy is expended in raising both the parts and media to an upper level for separation, and the parts are exposed to a substantial amount of part-to-part impingement during such operation. More fragile parts, such as plastic parts or parts formed with thin sections, are often damaged during such finishing operations.

Thus, it is an object of this invention to provide a method and means for finishing parts in a vibratory bowl-type finishing device, but wherein the requirement for additional energy to raise the parts from a lower zone to an upper zone for separation from the media is completely eliminated and wherein part-to-part impingement is greatly reduced thereby to adapt the vibratory bowl system to the finishing of fragile parts and with reduced harshness on the parts during processing.

These and other objects and advantages of this invention will hereinafter appear, and, for purposes of illustration, but not of limitation, an embodiment of the invention is shown in the accompanying drawing in which:

FIG. 1 is a schematic sectional elevational view of a vibratory finishing device embodying the features of this invention;

FIG. 2 is a top plan view of the device shown in FIG. 1; and

Figure 3:
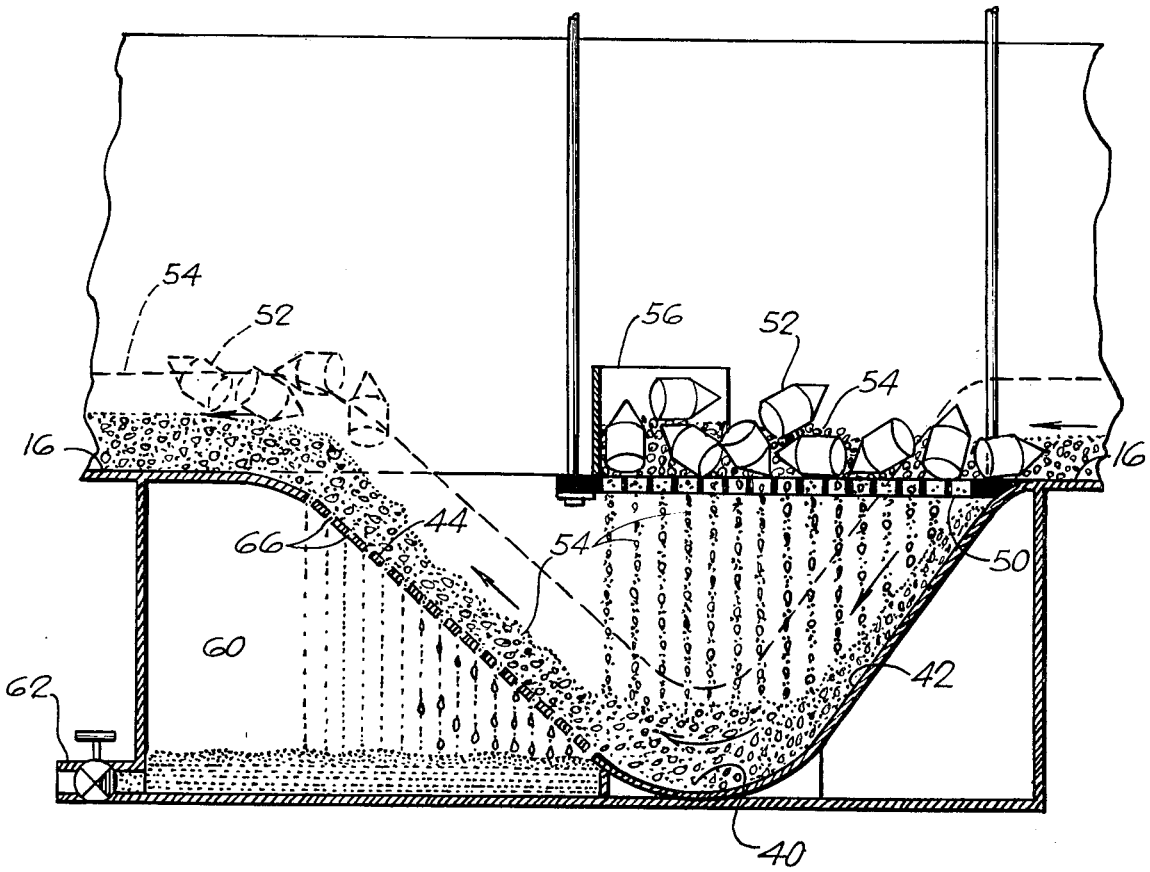
FIG. 3 is an enlarged cross-sectional view taken along the line 3—3 of FIG. 1.

In the drawings, illustration is made of a vibratory device which includes a circular bowl 10 having a cross section in the form of a U-shaped channel which is open at the top and which is defined by a pair of axially spaced, vertically disposed cylindrical sections which form the vertical side walls 12 and 14 joined at their lower ends by a curvilinear bottom wall 16.

A shaft 18 extends along the vertical axis of the bowl with means mounting the shaft for rotational movement by means of a variable speed electrical motor 20 mounted by means of a bracket 22 to the bowl 10. Eccentric weights 24 and 26 are fixed to vertically spaced-apart portions of the shaft to impart vibratory movement to the bowl in response to rotational movement of the shaft. The bowl and its supported motor, eccentrics and shaft, is supported on a plurality of circumferentially spaced-apart coil springs 28 on a base 30 which enables vibratory movement of the bowl relative to its support. During the finishing operation, parts and media are caused to travel in an elliptical path in one direction about the bowl, as illustrated in FIG. 2.

Instead of making use of a bowl which is entirely of a circular configuration, it may be desirable, for purposes of accommodating part separation and removal means, to form the bowl with a short, straight segment or cord, but it will be understood that the concepts of the invention can be accommodated in either configuration.

In accordance with the practice of this invention, the bottom wall 16 of the trough forming the bowl is turned downwardly through a short segment of the bowl to form a well 40, the leading edge 42 of which may extend sharply downwardly angularly from the bottom wall 16 of the trough or almost perpendicularly downwardly from the bottom wall of the trough, while the trailing edge 44 extends gradually upwardly from the bottom of the wall to the bottom wall 16, such as at an angle of about 30° to 60° and preferably at an angle within the range of 40° to 50°. The well 40 is dimensioned to extend only through a small part of the circumference of the bowl, such as through an angle of 5° to 20° to represent but a small segment thereof.

A separating screen 50 is mounted onto the inner side wall of the bowl for rocking movement between raised position out of the path of the particulate material and lowered or operative position wherein the screening member extends horizontally across the trough as a continuation of the bottom wall of the trough. It is dimensioned to have a length to extend over the initial portion of the well 40 and to terminate before the end of the well and preferably to extend over one-fourth to three-fourths of the length of the well.

The screen 50 is formed with perforations dimensioned to be less than the dimension of the parts 52 but greater than the cross section of the media 54. Thus when the screening member 50 is inserted into operative position, the parts 52 will be retained on the surface while the media 54 will sift through the openings and fall gravitationally to the bottom of the well in the portion underlying the screen thereby to effect separation of the parts from the media.

In response to continued vibratory actuation, the media 54 will continue to move in the same direction from the bottom of the well, up the inclined trailing edge 44 for re-entry into the trough, while the parts 52, separated on the surface of the screen, will be guided by a deflector 56 to an aligned opening 58 in the outer side wall of the bowl for delivery of the finished parts from the bowl.

In practice, the parts and media will circulate about the bowl, along an orbital path, in response to vibratory movement. Until the part-finishing operation is completed, the screening member 50 will be positioned out of the path of the parts and media so that the latter will pass into and out of the well during their course of travel about the bowl. When the finishing operation has been completed, the screening member 50 is inserted into its lowered or operative position whereupon the parts and media travel directly from the bottom wall 16 onto the screen 50 during continued vibratory actuation. The parts 52 will remain on the surface of the screen over which they will be deflected for delivery from the bowl, while the media 54 will sift through the screen and fall gravitationally to the bottom of the well from which the media will emerge as it rises up the trailing edge onto the downstream portion of the bottom wall 16 to re-enter the trough.

Other parts to be finished can be added to the media, preferably in an area beyond the well, and the cycle is repeated.

By way of modification, the bottom wall of the well, and preferably the trailing edge 44, is formed with perforations dimensioned to enable liquid and entrained dust and fines to flow through the openings into an underlying compartment 60 provided with a suitable drain 62 for removal. Thus liquid admixed with the media for enhancing the surface treatment of the parts can be removed along with dusts, dirt, and undersized media, if desired.

It is particularly beneficial to locate the openings 66 in the portion of the wall leading from the well, since the inner action of the media in this area such as to free the dusts and dirt and broken-down media for treatment with the liquid and their removal from the system. The depth of the media is less and the pressure on the media is greater in this particular area thereby to enhance the mechanics of removal or drainage through the openings.

The depth of the well 40 below the bottom wall 16 of the trough should be greater than the depth of the layer of media in the trough so that the screen 50 will be spaced above the upper level of the media in the well so as not to interfere with the free flow of media through the screen openings.

It will be apparent from the foregoing that a simple and efficient means is provided in a circular bowl-type vibratory device of the type described wherein the parts to be finished remain at the same level during the finishing operation while enabling media to be separated therefrom in a simple and efficient manner and which requires very little modification of the device from the standpoint of the separation operation.

It will be observed also that the parts remain admixed with the media throughout substantially the entire operation except for the minor length during passage over the screen for separtion of the media from the parts thereby to minimize part-to-part impingement during the separation operation.

It will be understood that changes may be made in the details of construction, arrangement and operation, without departing from the spirit of the invention, especially as defined in the following claims.

I claim:

1. A finishing mill having a substantially annular trough adapted to contain media and parts, means for vibrating the trough to cause the media and parts therein to travel in admixture about the trough, the improvement for separating the parts from the media comprising a segment forming a part of the trough but extending downwardly as a well to below the normal level of the bottom of the trough with the return from the well to the bottom of the trough being at a relatively small incline, and a separating screen positionable to extend crosswise of the trough substantially as a continuation of the bottom wall thereof to overlie an initial portion of the well to retain the parts on the surface thereof while the media passes through into the underlying portion of the well for return to the trough, and means for removing the parts from the surface of the separating screen.

2. A finishing mill as claimed in claim 1 in which the separating screen is mounted for movement between inoperative position out of the path of the parts and media and operative position to extend crosswise of the trough substantially as a continuation of the bottom wall.

3. A finishing mill as claimed in claim 1 in which the separating screen is dimensioned to have a length less than the length of the well so as to terminate short of the point of mergence of the return from the well with the bottom wall of the trough.

4. A finishing mill as claimed in claim 1 in which the return is formed with passages extending therethrough dimensioned to be smaller than the media for separation of fluid, fines and undersized media by drainage therethrough, and means for removing the material drained through said opening.

5. A finishing mill as claimed in claim 1 in which the well extends through a small angle of the annular trough.

6. A finishing mill as claimed in claim 5 in which the angle is 5°–20°.

7. A finishing mill as claimed in claim 1 in which the return is inclined at an angle of 30°–60°.

8. A finishing mill as claimed in claim 1 in which the return is inclined at an angle of 40°–50°.

9. A finishing mill as claimed in claim 1 which includes a deflector on the surface of the separating screen for displacement of the separated parts to the removal means.

10. A method for treating parts comprising introducing said parts and media into a first zone at a normal level, subjecting said mixture of parts and media to vibratory action whereby said parts and media travel in one direction through said first zone, into a second zone at a lower level and which follows as a continuation of the first zone and back to the first zone at normal level, and upon completion of the treatment of said parts, introducing a screening member at normal level as a continuation of said first zone and overlying at least a portion of said second zone whereby the parts and media travel from said first zone on to said screening member, separating the parts from the media while over said second zone to retain the parts in the first zone while the media falls gravitationally to the lower second zone, returning the media from the lower second zone to the first normal zone beyond said second zone, and removing the parts separated from the media.

11. The method as claimed in claim 10 in which the second zone is dimensioned to have a length which is a small fraction of the length of the first zone.

12. The method as claimed in claim 10 which includes the step of removing fluids, dust and fines from the media during return from the second zone to the first zone.

* * * * *